US011480344B2

(12) United States Patent
Meng et al.

(10) Patent No.: US 11,480,344 B2
(45) Date of Patent: Oct. 25, 2022

(54) MULTI-SPLIT AIR CONDITIONER AND CONTROL METHOD THEREFOR

(71) Applicants: Qingdao Haier Air-Conditioning Electronic Co., Ltd, Shandong (CN); HAIER SMART HOME CO., LTD, Shandong (CN)

(72) Inventors: Qingliang Meng, Shandong (CN); Qiang Song, Shandong (CN); Jiangbin Liu, Shandong (CN); Jingsheng Liu, Shandong (CN); Yun Zhang, Shandong (CN); Tao Yuan, Shandong (CN)

(73) Assignees: QINGDAO HAIER AIR-CONDITIONING ELECTRONIC CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 82 days.

(21) Appl. No.: 17/112,735

(22) Filed: Dec. 4, 2020

(65) Prior Publication Data

US 2021/0088232 A1 Mar. 25, 2021

Related U.S. Application Data

(63) Continuation-in-part of application No. PCT/CN2018/102922, filed on Aug. 29, 2018.

(51) Int. Cl.
*F24F 1/0003* (2019.01)
*F24F 11/65* (2018.01)

(52) U.S. Cl.
CPC ..... *F24F 1/0003* (2013.01); *F24F 11/65* (2018.01)

(58) Field of Classification Search
CPC ..... F24F 1/0003; F24F 2110/12; F24F 1/46; F24F 11/65; F25B 2313/009;
(Continued)

(56) References Cited

U.S. PATENT DOCUMENTS 2,279,657 A * 4/1942 Crawford ..... F24F 11/30 237/19
2012/0042678 A1* 2/2012 Park ..... F24D 19/1072 62/324.1

(Continued)

FOREIGN PATENT DOCUMENTS

CN 2682318 Y * 3/2005
CN 2682318 Y 3/2005

(Continued)

OTHER PUBLICATIONS

CN-103388863-A Translation (Year: 2013).*

(Continued)

*Primary Examiner* — Schyler S Sanks
(74) *Attorney, Agent, or Firm* — Calfee, Halter & Griswold LLP

(57) ABSTRACT

A multi-split air conditioner and control method are provided. The multi-split air conditioner includes an outdoor unit including an oil separator and a four-way valve. The outdoor unit includes a pipeline connecting the oil separator and the four-way valve, and the pipeline includes a first pipeline and a second pipeline arranged in parallel, wherein the first pipeline is provided with a heat storage module and a heat storage module control valve, and the second pipeline is provided with a first control valve. When the outdoor environment temperature satisfies a certain condition, the first pipeline and the second pipeline are controlled, so that at least part of working medium circulates in the first pipeline between the oil separator and the four-way valve through the heat storage module.

8 Claims, 2 Drawing Sheets

(58) Field of Classification Search
CPC ..... F25B 2313/02741; F25B 27/002; F25B 27/005; F25B 31/004
See application file for complete search history.

(56) References Cited

U.S. PATENT DOCUMENTS

| | | | | |
|---|---|---|---|---|
| 2014/0000840 | A1* | 1/2014 | Yang | F24F 5/001 165/59 |
| 2014/0130539 | A1* | 5/2014 | Yoon | F25B 31/004 62/470 |
| 2017/0130996 | A1* | 5/2017 | Hatanaka | F25B 13/00 |

FOREIGN PATENT DOCUMENTS

| | | | | |
|---|---|---|---|---|
| CN | 101162102 | A | | 4/2008 |
| CN | 100516676 | C | | 7/2009 |
| CN | 102901169 | A | | 1/2013 |
| CN | 103388863 | A | * | 11/2013 |
| CN | 103398438 | A | | 11/2013 |
| CN | 203323463 | U | | 12/2013 |
| CN | 204853777 | U | | 12/2015 |
| CN | 105823152 | A | | 8/2016 |
| JP | H0387576 | A | | 4/1991 |
| JP | 2008281290 | A | | 11/2008 |

OTHER PUBLICATIONS

CN2682318Y Translation (Year: 2005).*
International Search Report from International Application No. PCT/CN2018/102922 dated Jan. 29, 2019.
Office Action from Chinese Application No. 201810587508.4 dated Mar. 29, 2019.

* cited by examiner

MULTI-SPLIT AIR CONDITIONER AND CONTROL METHOD THEREFOR

CROSS-REFERENCE TO RELATED APPLICATIONS

The application is a Continuation-in-part of International Application No. PCT/CN2018/102922, filed Aug. 29, 2018, which is based upon and claims priority to Chinese Patent Application No. 201810587508.4, filed Jun. 6, 2018, the entire contents of which are incorporated herein by reference.

TECHNICAL FIELD

The present disclosure relates to the field of air conditioner technologies, and more particularly, to a multi-split air conditioner and a control method thereof.

BACKGROUND

Multi-split air conditioners generally include heat pump air conditioners for cooling and heating, or water heaters for making hot water, or air-conditioning water heaters with functions of cooling, heating, making the hot water and cooling and making the hot water at the same time, or energy-saving air conditioners with cool storage function. To a certain extent, these systems provide needs such as constant environment temperature and humidity and domestic water such as the hot water in people's daily life.

A multi-split air conditioner in the prior art cannot be adjusted according to a change of outside environment temperature. When the outside environment temperature is high or low, a load of the multi-split air conditioner obviously increases, which seriously affects service life and performance of the multi-split air conditioner.

SUMMARY

Embodiments of the present disclosure provide a multi-split air conditioner and a control method thereof, so as to solve the problem that the load of the multi-split air conditioner increases obviously when the outside environment temperature is high or low in the prior art. In order to have a basic understanding of some aspects of the disclosed embodiments, a brief summary is given below. This summary is not a general comment, nor is it intended to identify key/important constituent elements or describe the scope of protection of these embodiments. The sole purpose thereof is to present some concepts in a simplified form as a preface to the following detailed description.

According to a first aspect of the embodiments of the present disclosure, there is provided a multi-split air conditioner, including an outdoor unit, wherein the outdoor unit includes an oil separator and a four-way valve, and further includes:

a pipeline connecting the oil separator and the four-way valve;

wherein the pipeline includes a first pipeline and a second pipeline arranged in parallel, wherein the first pipeline is provided with a heat storage module and a heat storage module control valve, and the second pipeline is provided with a first control valve;

when outdoor environment temperature satisfies a certain condition, the first pipeline and the second pipeline are controlled, so that at least part of working medium circulates in the first pipeline between the oil separator and the four-way valve through the heat storage module.

In some optional embodiments, the multi-split air conditioner further includes: a hot water system connected to the heat storage module through a third pipeline and a fourth pipeline;

wherein the third pipeline is provided with a second control valve, and the fourth pipeline is provided with a third control valve.

In some optional embodiments, the hot water system includes: a solar collector and a water tank connected to the solar collector;

wherein a first port of the solar collector is connected to a first port of the water tank through a fifth pipeline, wherein the fifth pipeline is sequentially provided with a fourth control valve, a first three-way and a sixth control valve, and the fourth pipeline is connected to the fifth pipeline through the first three-way;

a second port of the solar collector is connected to a second port of the water tank through a sixth pipeline, wherein the sixth pipeline is sequentially provided with a fifth control valve, a second three-way and a seventh control valve, and the third pipeline is connected to the sixth pipeline through the second three-way.

In some optional embodiments, the outdoor unit further includes: a gas-liquid separator;

wherein one end of the gas-liquid separator is connected to a compressor, the other end of the gas-liquid separator is connected to the four-way valve through a seventh pipeline, and the seventh pipeline is provided with an eighth control valve.

In some optional embodiments, the outdoor unit further includes: an outdoor heat exchanger, wherein both ends of the outdoor heat exchanger are respectively connected to the four-way valve and an indoor heat exchanger.

In some optional embodiments, a pipeline connecting the outdoor heat exchanger and the four-way valve is provided with a ninth control valve.

In some optional embodiments, a pipeline between an outlet of the outdoor heat exchanger and an inlet of the indoor heat exchanger is sequentially provided with a tenth control valve and an eleventh control valve and an outdoor electronic expansion valve arranged in parallel.

In some optional embodiments, the outdoor environment temperature satisfies the certain condition includes: the outdoor environment temperature is greater than or equal to a first set value and the outdoor environment temperature is less than a fourth set value.

According to a second aspect of the embodiments of the present disclosure, there is provided a control method of a multi-split air conditioner, which is the above-mentioned multi-split air conditioner, wherein the control method includes:

obtaining outdoor environment temperature;

when the outdoor environment temperature satisfies a certain condition, controlling a first pipeline and a second pipeline, so that at least part of working medium circulates in the first pipeline between an oil separator and a four-way valve through a heat storage module, wherein the heat storage module absorbs heat from the working medium.

In some optional embodiments, after the heat storage module absorbs the heat from the working medium, the control method further includes:

closing a second control valve, a third control valve, a fourth control valve and a fifth control valve, and disconnecting a sixth control valve and a seventh control valve, so that the heat storage module heats water in a water tank by using the absorbed heat.

Some technical solutions provided by the embodiments of the present disclosure may achieve following technical effects.

The embodiments of the present disclosure provide a multi-split air conditioner, including an outdoor unit, wherein the outdoor unit includes an oil separator and a four-way valve, and further includes: a pipeline connecting the oil separator and the four-way valve; wherein the pipeline includes a first pipeline and a second pipeline arranged in parallel, wherein the first pipeline is provided with a heat storage module and a heat storage module control valve, and the second pipeline is provided with a first control valve; when outdoor environment temperature satisfies a certain condition, the first pipeline and the second pipeline are closed, so that at least part of working medium circulates in the first pipeline between the oil separator and the four-way valve through the heat storage module.

According to the embodiments of the present disclosure, the first pipeline and the second pipeline are arranged in parallel between the oil separator and the four-way valve, the first pipeline is provided with the heat storage module and the heat storage module control valve, the second pipeline is provided with the first control valve, when the outdoor environment temperature satisfies the certain condition, the first pipeline and the second pipeline are controlled, so that at least part of working medium circulates between the oil separator and the four-way valve through the heat storage module; when the working medium passes through the heat storage module, heat transfer is carried out between the heat storage module and the working medium, and thus the load of the multi-split air conditioner is reduced, and the performance of the multi-split air conditioner is prevented from being lowered due to excessive load.

It should be understood that both the foregoing general description and the following detailed description are exemplary and explanatory only and are not intended to limit the present disclosure.

BRIEF DESCRIPTION OF THE DRAWINGS

The accompanying drawings, which are incorporated in and constitute a part of this description, illustrate embodiments consistent with the present disclosure and, together with the description, serve to explain the principles of the present disclosure.

Figure 1:
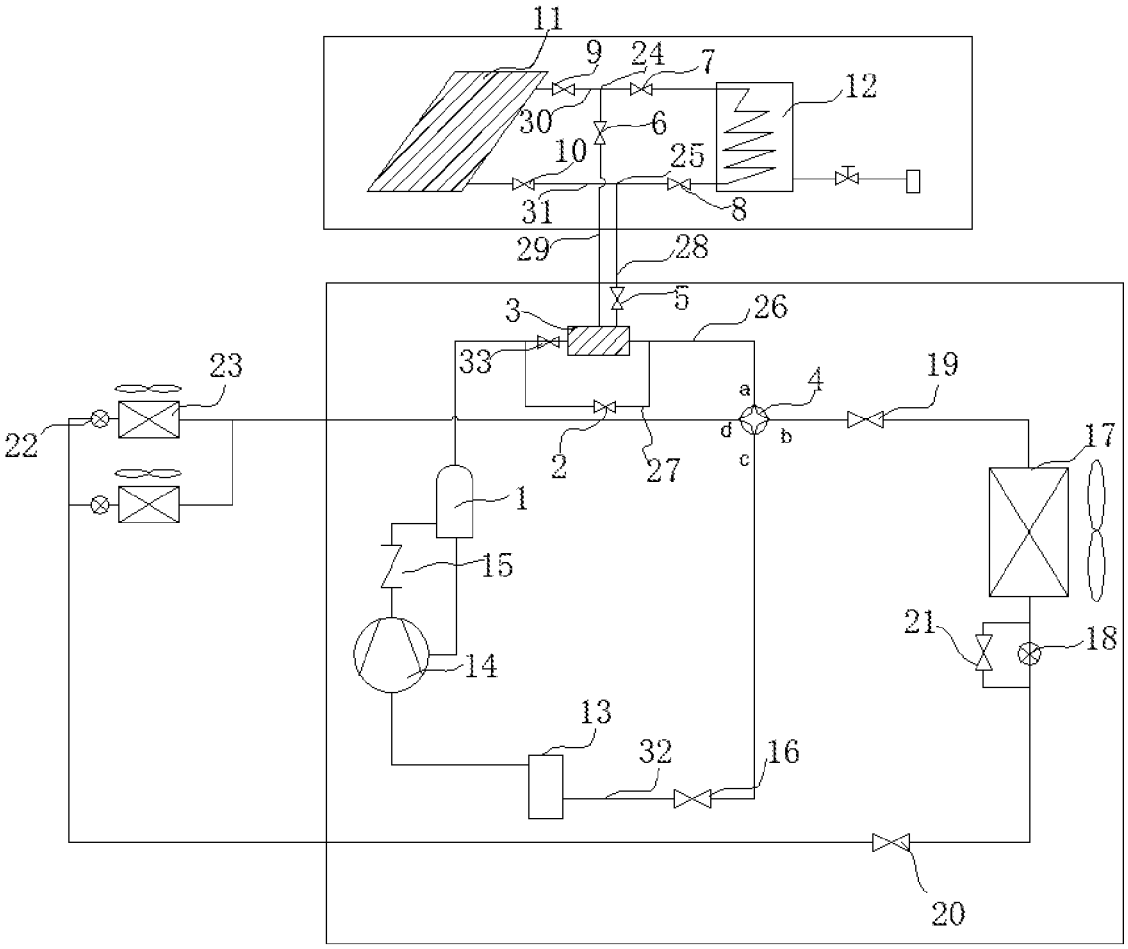
FIG. 1 is a schematic structural diagram illustrating a multi-split air conditioner according to an exemplary embodiment.

Description of reference signs: 1. oil separator; 2. first control valve; 3. heat storage module; 4. four-way valve; 5. second control valve; 6. third control valve; 7. fourth control valve; 8. fifth control valve; 9. sixth control valve; 10. seventh control valve; 11. solar collector; 12. water tank; 13. gas-liquid separator; 14. compressor; 15. one-way valve; 16. eighth control valve; 17. outdoor heat exchanger; 18. outdoor electronic expansion valve; 19. ninth control valve; 20. tenth control valve; 21. eleventh control valve; 22. indoor electronic expansion valve; 23. indoor heat exchanger; 24. first three-way; 25. second three-way; 26. first pipeline; 27. second pipeline; 28. third pipeline; 29. fourth pipeline; 30. fifth pipeline; 31. sixth pipeline; 32. seventh pipeline; 33. heat storage module control valve.

DETAILED DESCRIPTION

The following description and accompanying drawings fully illustrate the specific implementation solutions of the present disclosure, so that a person skilled in the art can practice them. Parts and characteristics of some implementation solutions may be included in or replace parts and characteristics of other implementation solutions. The scope of the implementation solutions of the present disclosure includes the whole scope of the claims, and all available equivalents of the claims. As used herein, relationship terms such as "first" and "second" are merely for distinguishing one entity or structure from another entity or structure, and do not require or imply any actual relationship or sequence among these entities or structures. As used herein, each embodiment is described progressively, and contents focally described in each embodiment are different from those in other embodiments. The same or similar parts among each of the embodiments may be referred to each other.

In the description of the present disclosure, it should be noted that, orientations or positional relationships indicated by terms "longitudinal", "transverse", "upper", "lower", "front", "back", "left", "right", "vertical", "horizontal", "top", "bottom", "inner", "outer" and the like as used herein are based on orientations or positional relationships shown in the drawings, merely for facilitating describing the present disclosure and simplifying the description, rather than indicating or implying that indicated devices or elements have to be in a specific orientation or configured and operated in a specific orientation, therefore, they should not be construed as limiting the present disclosure. In the description herein, it should be noted that, terms "mount", "join" and "connect" shall be construed in a broad sense, unless otherwise indicated and limited. For example, the connection may be mechanical connection or electrical connection, also may be internal communication between two elements, the connection may be direct connection or indirect connection through an intermediate medium. For a person of ordinary skill in the art, specific meanings of the above terms may be understood according to specific circumstances.

According to a first aspect of the embodiments of the present disclosure, there is provided a multi-split air conditioner, including an outdoor unit. FIG. 1 is a schematic structural diagram illustrating a multi-split air conditioner according to an exemplary embodiment. As shown in FIG. 1, the outdoor unit includes an oil separator 1 and a four-way valve 4, and a pipeline connecting the oil separator 1 and the four-way valve 4.

The pipeline includes a first pipeline 26 and a second pipeline 27 arranged in parallel, wherein the first pipeline 26 is provided with a heat storage module 3 and a heat storage module control valve 33; and the second pipeline 27 is provided with a first control valve 2.

When outdoor environment temperature is greater than or equal to a first set value, the heat storage module control valve 33 and the first control valve 2 are controlled, so that at least part of working medium circulates in the first pipeline 26 between the oil separator 1 and the four-way valve 4 through the heat storage module 3. As used herein, the term "working medium" refers to a working substance that realizes the conversion of heat and work, and is a medium substance through which various thermal engines or thermal equipment can complete the mutual conversion of thermal energy and mechanical energy. Examples includes combustion gas, water vapor, refrigerant and air, etc. For example, the mutual conversion between thermal energy and mechanical work is realized by a series of state changes of working medium.

According to the embodiments of the present disclosure, the first pipeline 26 and the second pipeline 27 are arranged in parallel between the oil separator 1 and the four-way valve 4, the first pipeline 26 is provided with the heat storage module 3 and the heat storage module control valve 33, the second pipeline 27 is provided with the first control valve 2, when the outdoor environment temperature is greater than or equal to the first set value, the heat storage module control valve 33 and the first control valve 2 are controlled, so that at least part of working medium circulates in the first pipeline 26 between the oil separator 1 and the four-way valve 4 through the heat storage module 3; when the working medium passes through the heat storage module 3, heat transfer is carried out between the heat storage module 3 and the working medium, and thus heat dissipation load of an outdoor heat exchanger 17 of the multi-split air conditioner is reduced, and the performance of the outdoor heat exchanger 17 is prevented from being lowered due to excessive load.

In some optional embodiments, the four-way valve 4 has a port a, a port b, a port c and a port d, wherein the oil separator 1 is connected to the port a of the four-way valve 4.

In some optional embodiments, the first set value may be a range value, such as greater than 20° C., or less than or equal to 30° C.

In some optional embodiments, the first set value may be a specific value, such as 25° C.

When the temperature is high in summer, the heat storage module 3 absorbs the heat of at least part of the working medium to reduce the heat dissipation load of the outdoor heat exchanger 17.

When the temperature is low in winter, the heat storage module 3 transfers the heat to the working medium to reduce the load of the multi-split air conditioner.

When the temperature is very high in summer, that is, when the outdoor environment temperature is greater than or equal to a second set value, where the second set value is greater than the first set value, the first control valve 2 is disconnected, the second pipeline 27 is cut off, and the heat storage module control valve 33 is closed, so that all the working media can circulate in the first pipeline 26 between the oil separator 1 and the four-way valve 4 through the heat storage module 3; and when the working medium passes through the heat storage module 3, the heat storage module 3 absorbs the heat of the working media to reduce the heat dissipation load of the outdoor heat exchanger 17 of the multi-split air conditioner, and prevent the performance of the outdoor heat exchanger 17 from being lowered due to excessive load.

When the outdoor environment temperature is greater than or equal to the first set value, the heat storage module control valve 33 and the first control valve 2 are closed, so that at least part of the working medium circulates in the first pipeline 26 between the oil separator 1 and the four-way valve 4 through the heat storage module 3; and when the working medium passes through the heat storage module 3, the heat storage module 3 absorbs the heat of the working medium to reduce the heat dissipation load of the outdoor heat exchanger 17 of the multi-split air conditioner, and prevent the performance of the outdoor heat exchanger 17 from being lowered due to excessive load.

In some optional embodiments, the second set value may be a range value, such as greater than 30° C., or less than or equal to 45° C.

In some optional embodiments, the second set value may be a specific value, such as 40° C.

In some optional embodiments, the multi-split air conditioner further includes: a hot water system connected to the heat storage module 3 through a third pipeline 28 and a fourth pipeline 29.

The third pipeline 28 is provided with a second control valve 5, and the fourth pipeline 29 is provided with a third control valve 6.

By adding the hot water system to the multi-split air conditioner, the hot water system and the air conditioning system can be combined to make full use of energy and avoid waste of resources.

In some optional embodiments, the hot water system includes: a solar collector 11 and a water tank 12 connected to the solar collector 11.

A first port of the solar collector 11 is connected to a first port of the water tank 12 through a fifth pipeline 30, wherein the fifth pipeline 30 is sequentially provided with a fourth control valve 7, a first three-way 24 and a sixth control valve 9, and the fourth pipeline 29 is connected to the fifth pipeline 30 through the first three-way 24.

A second port of the solar collector 11 is connected to a second port of the water tank 12 through a sixth pipeline 31, wherein the sixth pipeline 31 is sequentially provided with a fifth control valve 8, a second three-way 25 and a seventh control valve 10, and the third pipeline 28 is connected to the sixth pipeline 31 through the second three-way 25.

By arranging the first three-way 24 and the second three-way 25, the heat storage module 3 is connected to the hot water system, and the air conditioning system and the hot water system are combined to make full use of the energy in the natural environment.

At daytime in winter, when a temperature of a refrigerant in the solar collector 11 is greater than or equal to a third set value, the fourth control valve 7 and the fifth control valve 8 are disconnected, and the second control valve 5, the third control valve 6, the sixth control valve 9 and the seventh control valve 10 are closed, so that the heat storage module 3 absorbs the heat in the solar collector 11; at night in winter, when the outdoor environment temperature is less than a fourth set value, the heat storage module control valve 33 and the first control valve 2 are closed to realize the closing of the first pipeline and the second pipeline, so that at least part of the working medium circulates in the first pipeline 26 between the oil separator 1 and the four-way valve 4 through the heat storage module 3, and the heat storage module 3 transfers the heat to the working medium to reduce the load of a compressor 14, so that the heat from the solar collector 11 can be absorbed by the heat storage module 3 at daytime; and when the temperature is low at night, the heat storage module 3 can transfer the heat to the air conditioning system to reduce the impact of environment temperature changes on the load of the compressor 14, and make full use of the heat from the solar heat collector 11, which not only saves energy and protects the environment, but also prolongs the service life of the compressor 14.

In some optional embodiments, the outdoor unit further includes: a gas-liquid separator 13.

One end of the gas-liquid separator 13 is connected to the compressor 14, the other end of the gas-liquid separator 13 is connected to the port c of the four-way valve 4 through a seventh pipeline 32, and the seventh pipeline 32 is provided with an eighth control valve 16 for controlling on and off of the seventh pipeline 32.

In some optional embodiments, both ends of the outdoor heat exchanger 17 are respectively connected to the port b of the four-way valve 4 and an indoor heat exchanger 23.

A pipeline connecting the outdoor heat exchanger 17 and the port b of the four-way valve is provided with a ninth control valve 19, and on and off of the pipeline can be controlled by the ninth control valve 19.

In some optional embodiments, a pipeline between an outlet of the outdoor heat exchanger 17 and an inlet of the indoor heat exchanger 23 is sequentially provided with a tenth control valve 20 and an eleventh control valve 21 and an outdoor electronic expansion valve 18 arranged in parallel, wherein the eleventh control valve 21 and the outdoor electronic expansion valve 18 can be selectively used.

In some optional embodiments, the number of the indoor heat exchangers 23 is one or more, and each indoor heat exchanger 23 is provided with an indoor electronic expansion valve 22. In FIG. 1, there are two indoor heat exchangers 23, so that one outdoor heat exchanger 17 corresponds to a plurality of indoor heat exchangers 23.

During a refrigeration cycle, refrigerant gas discharged from the compressor 14 passes through a one-way valve 15, the oil separator 1, the heat storage module 3 and the heat storage module control valve 33 or the first control valve 2 and is connected to the port a and the port b of the four-way valve 4, and then passes through the ninth control valve 19, the outdoor heat exchanger 17, the eleventh control valve 21 or the outdoor electronic expansion valve 18, the tenth control valve 20, the indoor electronic expansion valve 22, the indoor heat exchanger 23 and is connected to the port d and the port c of the four-way valve 4, passes through the eighth control valve 16, the gas-liquid separator 13 and is connected to a suction end of the compressor 14 to complete a refrigeration cycle.

During a heating cycle, the refrigerant gas discharged from the compressor 14 passes through the one-way valve 15, the oil separator 1, the heat storage module 3 and the heat storage module control valve 33 or the first control valve 2 and is connected to the port a and the port d of the four-way valve 4, and then passes through the indoor heat exchanger 23, the indoor electronic expansion valve 22, the tenth control valve 20, the eleventh control valve 21 or the outdoor electronic expansion valve 18, the outdoor heat exchanger 17, the ninth control valve 19 and is connected to the port b and the port c of the four-way valve 4, passes through the eighth control valve 16, the gas-liquid separator 13 and is connected to a suction end of the compressor 14 to complete the heating cycle.

In the embodiments of the present disclosure, by adding the heat storage module 3, when the temperature in summer is higher than the first set value, the heat of at least part of the working medium in the air conditioning system can be absorbed by the heat storage module 3 for heating the water in the water tank 12 to share the heat dissipation load of the outdoor heat exchanger 17; in winter, when the outdoor environment temperature is less than the fourth set value, the heat of the solar collector 11 absorbed by the heat storage module 3 is supplemented to the air conditioning system. The further function of the heat storage module 3 is reflected in summer and winter, no matter how the outdoor environment temperature changes, a frequency of the compressor 14 can be within a relatively stable range by controlling the heat storage module 3, that is, the overall performance of the whole multi-split air conditioner can be guaranteed.

Therefore, by adding the heat storage module 3 in the air conditioning system, the influence of outdoor working condition fluctuations on the compressor 14 can be reduced, the reliability of the air conditioning system can be improved, and the service life of the compressor 14 can be prolonged.

Furthermore, in the embodiments of the present disclosure, the heat storage module 3 can improve a Coefficient of Performance (COP) of the multi-split air conditioner under certain conditions. For example, in summer, when the outdoor environment temperature exceeds rated working condition temperature of the multi-split air conditioner by a large amount, the compressor 14 can still run near the rated working condition due to the addition of the heat storage module 3, which makes the power consumption of the whole air conditioning system smaller than that without adding the heat storage module 3, therefore, when the cooling capacity is unchanged, the efficiency of the whole air conditioning system will be improved compared with that without adding the heat storage module 3; in winter, when the outdoor working condition is lower than the rated working condition by a large amount, the efficiency of the whole air conditioning system will also be higher than that without adding the heat storage module 3, therefore, adding the heat storage module 3 will obviously improve the efficiency of the multi-split air conditioner.

Figure 2:
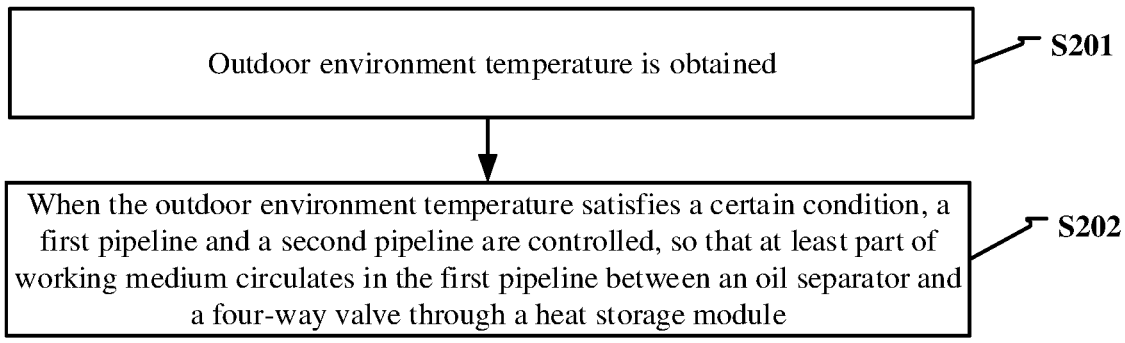
FIG. 2 is a flow chart illustrating a control method of a multi-split air conditioner according to an exemplary embodiment.

According to a second aspect of the embodiments of the present disclosure, there is provided a control method of a multi-split air conditioner, which is the above-mentioned multi-split air conditioner. As shown in FIG. 2, the control method includes:

S201, outdoor environment temperature is obtained;

S202, when the outdoor environment temperature satisfies a certain condition, a first pipeline and a second pipeline are controlled, so that at least part of working medium circulates in the first pipeline 26 between an oil separator 1 and a four-way valve 4 through a heat storage module 3, wherein the heat storage module 3 absorbs heat from the working medium.

In some optional embodiments, the first set value may be a range value, such as greater than 20° C., or less than or equal to 30° C.

In some optional embodiments, the first set value may be a specific value, such as 25° C.

Figure 3:
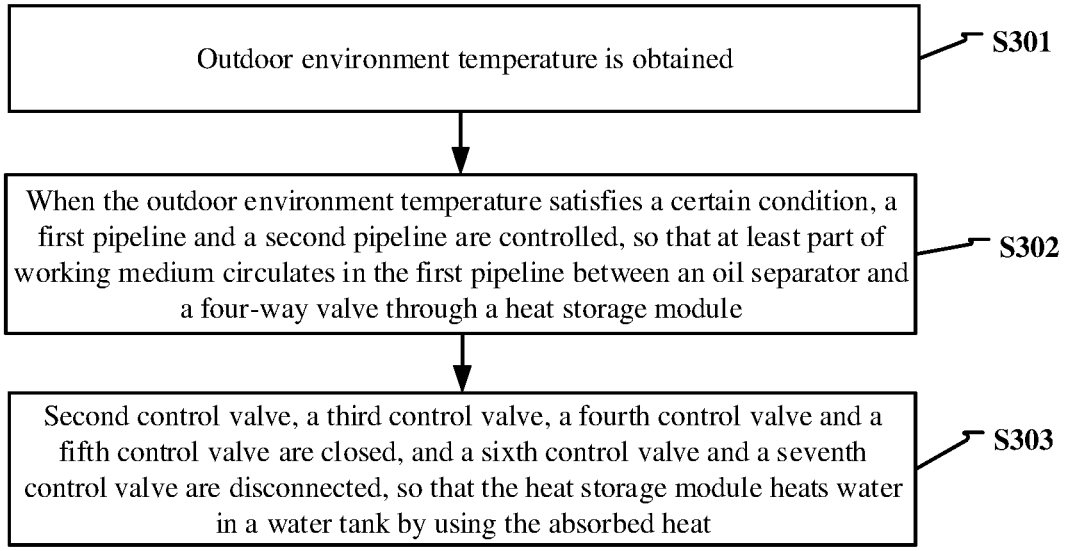
FIG. 3 is a flow chart illustrating a control method of a multi-split air conditioner according to an exemplary embodiment.

In some optional embodiments, after the heat storage module 3 absorbs the heat from the working medium, as shown in FIG. 3, the control method further includes:

S301, outdoor environment temperature is obtained;

S302, when the outdoor environment temperature satisfies a certain condition, a first pipeline and a second pipeline are controlled, so that at least part of working medium circulates in the first pipeline 26 between an oil separator 1 and a four-way valve 4 through a heat storage module 3, wherein the heat storage module 3 absorbs heat from the working medium.

The outdoor environment temperature satisfies the certain condition includes: the outdoor environment temperature is greater than or equal to a first set value and the outdoor environment temperature is less than a fourth set value.

After S301 and S302, the control method further includes:

S303, a second control valve 5, a third control valve 6, a fourth control valve 7 and a fifth control valve 8 are closed, and a sixth control valve 9 and a seventh control valve 10 are disconnected, so that the heat storage module 3 heats water in a water tank 12 by using the absorbed heat.

With this method, the heat in the heat storage module 3 can be used to heat the water in the water tank 12, so as to fully utilize the energy.

Figure 4:
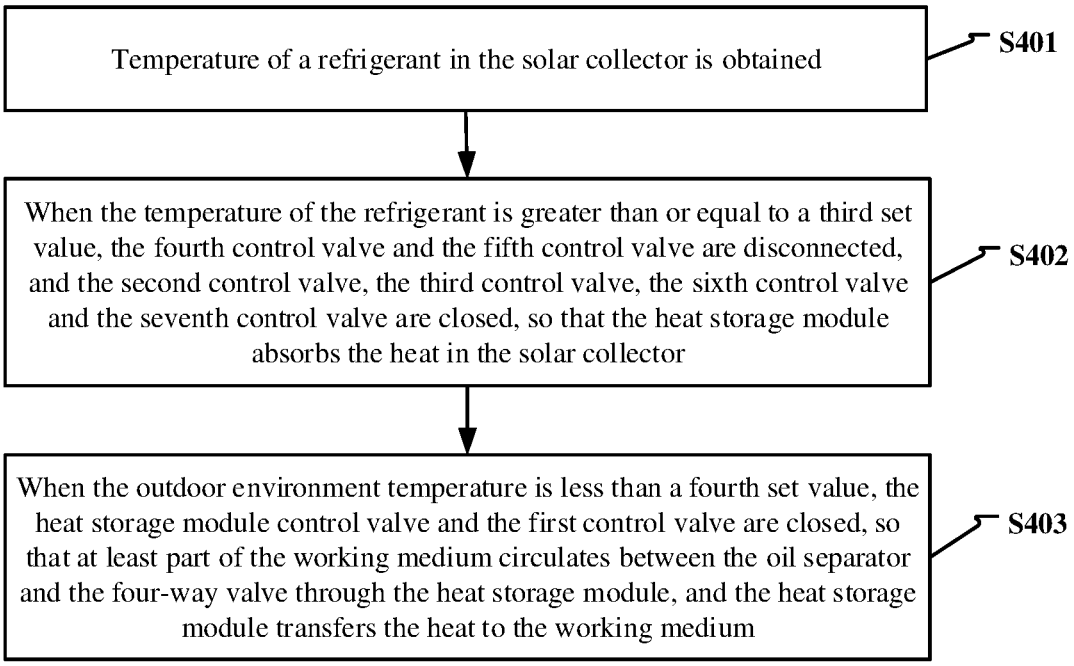
FIG. 4 is a flow chart illustrating a control method of a hot water system of a multi-split air conditioner according to an exemplary embodiment.

In some optional embodiments, FIG. 4 is a flow chart illustrating a control method of a hot water system of a multi-split air conditioner according to an exemplary embodiment. As shown in FIG. 4, the control method includes:

S401, a temperature of a refrigerant in the solar collector 11 is obtained;

S402, when the temperature of the refrigerant is greater than or equal to a third set value, the fourth control valve 7 and the fifth control valve 8 are disconnected, and the second control valve 5, the third control valve 6, the sixth control valve 9 and the seventh control valve 10 are closed, so that the heat storage module 3 absorbs the heat in the solar collector 11;

S403, when the outdoor environment temperature is less than a fourth set value, the heat storage module control valve 33 and the first control valve 2 are closed to realize the closing of the first pipeline and the second pipeline, so that at least part of the working medium circulates in the first pipeline 26 between the oil separator 1 and the four-way valve 4 through the heat storage module 3, and the heat storage module 3 transfers the heat to the working medium to reduce the load of a compressor 14.

This method is suitable for winter. When the temperature is high during the day, that is, when the temperature of the refrigerant is greater than or equal to the third set value, the fourth control valve 7 and the fifth control valve 8 are disconnected, and the second control valve 5, the third control valve 6, the sixth control valve 9 and the seventh control valve 10 are closed, so that the heat storage module 3 absorbs the heat in the solar collector 11.

When the temperature is low at night, that is, when the outdoor environment temperature is less than the fourth set value, the heat storage module control valve 33 and the first control valve 2 are closed to realize the closing of the first pipeline and the second pipeline, so that at least part of the working medium circulates in the first pipeline 26 between the oil separator 1 and the four-way valve 4 through the heat storage module 3, and the heat storage module 3 transfers the heat to the working medium to reduce the load of a compressor 14.

Of course, by closing the heat storage module control valve 33 and disconnecting the first control valve 2, all the working media can circulate in the first pipeline 26 between the oil separator 1 and the four-way valve 4 through the heat storage module 3, and the heat storage module 3 transfers the heat to the working media to reduce the load of a compressor 14.

In some optional embodiments, the first set value may be a range value, such as greater than 20° C., or less than or equal to 30° C.

In some optional embodiments, the first set value may be a specific value, such as 25° C.

In some optional embodiments, the second set value may be a range value, such as greater than 30° C., or less than or equal to 45° C.

In some optional embodiments, the second set value may be a specific value, such as 40° C.

In some optional embodiments, the third set value may be a range value, such as greater than 35° C., or less than or equal to 60° C.

In some optional embodiments, the third set value may be a specific value, such as 40° C.

In some optional embodiments, the fourth set value may be a range value, such as greater than −20° C., or less than or equal to 3° C.

In some optional embodiments, the fourth set value may be a specific value, such as 0° C.

In the embodiments of the present disclosure, by adding the heat storage module 3, when the temperature in summer is higher than the first set value, the heat of at least part of the working medium in the air conditioning system can be absorbed by the heat storage module 3 for heating the water in the water tank 12 to share the heat dissipation load of the outdoor heat exchanger 17; in winter, when the outdoor environment temperature is less than the fourth set value, the heat of the solar collector 11 absorbed by the heat storage module 3 is supplemented to the air conditioning system. The further function of the heat storage module 3 is reflected in summer and winter, no matter how the outdoor environment temperature changes, a frequency of the compressor 14 can be within a relatively stable range by controlling the heat storage module 3, that is, the overall performance of the whole multi-split air conditioner can be guaranteed.

Therefore, by adding the heat storage module 3 in the air conditioning system, the influence of outdoor working condition fluctuations on the compressor 14 can be reduced, the reliability of the air conditioning system can be improved, and the service life of the compressor 14 can be prolonged.

Furthermore, in the embodiments of the present disclosure, the heat storage module 3 can improve a Coefficient of Performance (COP) of the multi-split air conditioner under certain conditions. For example, in summer, when the outdoor environment temperature exceeds rated working condition temperature of the multi-split air conditioner by a large amount, the compressor 14 can still run near the rated working condition due to the addition of the heat storage module 3, which makes the power consumption of the whole air conditioning system smaller than that without adding the heat storage module 3, therefore, when the cooling capacity is unchanged, the efficiency of the whole air conditioning system will be improved compared with that without adding the heat storage module 3; in winter, when the outdoor working condition is lower than the rated working condition by a large amount, the efficiency of the whole air conditioning system will also be higher than that without adding the heat storage module 3, therefore, adding the heat storage module 3 will obviously improve the efficiency of the multi-split air conditioner.

The control valves involved in the present disclosure may be solenoid valves, such as the first control valve 2, the second control valve 5, the third control valve 6, and the like.

The present disclosure is not limited to the structures already described above and shown in the accompanying drawings, and various modifications and changes may be made without departing from the scope. The scope of the present disclosure is limited only by the appended claims.

What is claimed is:

1. A multi-split air conditioner, comprising an outdoor unit, wherein the outdoor unit, comprises an oil separator and a four-way valve, and further comprising:

a pipeline connecting the oil separator and the four-way valve;

wherein the pipeline comprises a first pipeline and a second pipeline arranged in parallel, wherein the first pipeline is provided with a heat storage module and a heat storage module control valve;

the second pipeline is provided with a first control valve;

when outdoor environment temperature satisfies a certain condition, first pipeline and the second pipeline are controlled, so that at least part of working medium circulates in the first pipeline between the oil separator and the four-way valve through the heat storage module;

the multi-split air conditioner further comprises: a hot water system connected to the heat storage module through a third pipeline and a fourth pipeline;

wherein the third pipeline is provided with a second control valve, and the fourth pipeline is provided with a third control valve;

the hot water system comprises: a solar collector and a water tank connected to the solar collector;

wherein a first port of the solar collector is connected to a first port of the water tank through a fifth pipeline, wherein the fifth pipeline is sequentially provided with a fourth control valve, a first three-way and a sixth control valve, and the fourth pipeline is connected to the fifth pipeline through the first three-way;

a second port of the solar collector is connected to a second port of the water tank through a sixth pipeline, wherein the sixth pipeline is sequentially provided with a fifth control valve, a second three-way and a seventh control valve, and the third pipeline is connected to the sixth pipeline through the second three-way.

2. The multi-split air conditioner according to claim 1, wherein the outdoor unit further comprises: a gas-liquid separator, wherein one end of the gas-liquid separator is connected to a compressor, the other end of the gas-liquid separator is connected to the four-way valve through a seventh pipeline, and the seventh pipeline is provided with an eighth control valve.

3. The multi-split air conditioner according to claim 1, wherein the outdoor unit further comprises: an outdoor heat exchanger, wherein both ends of the outdoor heat exchanger are respectively connected to the four-way valve and an indoor heat exchanger.

4. The multi-split air conditioner according to claim 3, wherein a pipeline connecting the outdoor heat exchanger and the four-way valve is provided with a ninth control valve.

5. The multi-split air conditioner according to claim 3, wherein a pipeline between an outlet of the outdoor heat exchanger and an inlet of the indoor heat exchanger is sequentially provided with a tenth control valve and an eleventh control valve and an outdoor electronic expansion valve arranged in parallel.

6. The multi-split air conditioner according to claim 1, wherein the outdoor environment temperature satisfies the certain condition comprises: the outdoor environment temperature is greater than or equal to a first set value and the outdoor environment temperature is less than a fourth set value.

7. A control method of a multi-split air conditioner according to claim 1, wherein the control method comprises:

obtaining outdoor environment temperature;

when the outdoor environment temperature satisfies a certain condition, controlling a first pipeline and a second pipeline, so that at least part of working medium circulates in the first pipeline between an oil separator and a four-way valve through a heat storage module, wherein the heat storage module absorbs heat from the working medium.

8. The control method of the multi-split air conditioner according to claim 7, wherein after the heat storage module absorbs the heat from the working medium, the control method further comprises:

closing a second control valve, a third control valve, a fourth control valve and a fifth control valve, and disconnecting a sixth control valve and a seventh control valve, so that the heat storage module heats water in a water tank by using the absorbed heat.

* * * * *